US005092653A

United States Patent [19]

Felling

[11] Patent Number: 5,092,653

[45] **Date of Patent: * Mar. 3, 1992**

[54] CHAISE LOUNGE HAVING ADJUSTABLE CANOPY WITH COMBINED LOCK AND RETURN STRUT

[76] Inventor: Gerald J. Felling, 230 Arroyo Rd., P.O. Box 294, Lagunitas, Calif. 94938

[ * ] Notice: The portion of the term of this patent subsequent to May 14, 2008 has been disclaimed.

[21] Appl. No.: 528,819

[22] Filed: May 24, 1990

Related U.S. Application Data

[63] Continuation-in-part of Ser. No. 496,520, Mar. 20, 1990, which is a continuation of Ser. No. 482,190, Feb. 20, 1990, which is a continuation-in-part of Ser. No. 385,057, Jul. 26, 1989, abandoned.

[51] Int. Cl.[5] ..... A47C 7/10

[52] U.S. Cl. ..... 297/184; 297/306

[58] Field of Search ..... 297/184, 306; 135/96

[56] References Cited

U.S. PATENT DOCUMENTS

| | | | |
|---|---|---|---|
| 2,243,984 | 6/1941 | Singlwald | 297/184 X |
| 4,790,598 | 12/1988 | Locher | 297/325 |

FOREIGN PATENT DOCUMENTS

| | | | |
|---|---|---|---|
| 434019 | 7/1925 | Fed. Rep. of Germany | 297/184 |
| 489094 | 12/1929 | Fed. Rep. of Germany | 297/184 |
| 583596 | 1/1925 | France | 297/184 |
| 293675 | 10/1953 | Switzerland | 297/184 |

*Primary Examiner*—Laurie K. Cranmer
*Attorney, Agent, or Firm*—Phillips, Moore, Lempio & Finley

[57] ABSTRACT

A chaise lounge, usable for sunbathing and other recreational purposes, comprising a stationary base having a normally upright canopy pivotally mounted rearwardly thereon. The canopy, preferably comprising a hood-like structural frame covered with an open mesh and flexible material, is adapted to be pivoted between a normal upright position to form a seating arrangement and a lowered position placing a back of the canopy in alignment with a top of the base. At least one operator-controlled (from within the canopy) combined lock and return strut is pivotally interconnected between the canopy and the base to: (1) Releasably hold and lock the canopy in a selected position between its upright and lowered positions; and (2) Cushion lowered movements of the canopy and automatically return it to its upright position in response to release of the locking function. The strut may comprise a releasable torsion coil spring for selectively holding a reciprocal rod in a locked position, under torsional friction, and a compression coil spring for effecting the cushioning and return functions. A pair of laterally spaced struts can be pivotally interconnected between each side of the canopy and the frame or a single and centrally located strut can be utilized.

14 Claims, 2 Drawing Sheets

CHAISE LOUNGE HAVING ADJUSTABLE CANOPY WITH COMBINED LOCK AND RETURN STRUT

CROSS-REFERENCE TO RELATED APPLICATIONS

This application is a continuation-in-part of U.S. patent application Ser. No. 07/496,520, filed on Mar. 20, 1990 for "Chaise Lounge with Adjustable Canopy," which is a continuation-in-part of U.S. patent application Ser. No. 07/482,190, filed on Feb. 20, 1990 for "Sheltered Lounge Chair", which is, in return, a continuation-in-part of U.S. patent application Ser. No. 07/385,057, filed on July 26, 1989, now abandoned.

TECHNICAL FIELD

This invention relates generally to a recreational and vacational seating and lounging arrangement and more particularly to a chaise lounge having an adjustable canopy, including a backrest, adapted to be locked in an infinite number of positions between its upright and lowered positions.

BACKGROUND OF THE INVENTION

Chaise lounges, having canopies mounted thereon, have found widespread recreational and vacational use, particularly at beaches and on the sun decks and patios of homes and hotels. However, the backrest for this type of lounge, popular in Europe, is often-times fixed in position. Thus, the user is unable to adjust the backrest for his or her comfort. The lounge was later modified to permit the backrest to pivot on a base of the lounge. However, the externally operated mechanical locking systems utilized are difficult to manipulate and the substantial weight of the backrest (e.g. 75 lbs.) renders the lounge impracticable for every day use.

U.S. Pat. Nos. 2,243,984; 2,279,748 and 2,837,140 discloses various types of beach chairs wherein an adjustable backrest or canopy is pivotally mounted on a frame to adjust the inclination of the backrest from an upright position to a lowered position. Chairs of this type normally rely on legs or struts, positioned rearwardly of the pivot point whereat the backrest pivots on the frame, for supporting the weight of the person sitting or lying thereon.

Further, recreational lounges and chairs of the above-described types do not provide means for automatically returning the backrest to its upright position, under control of the person sitting in the chair. The adjustment and seating problems encountered with conventional canopy-covered lounging chairs are aggravated when the covering material for the canopy thereof comprises an open mesh, flexible material which will not exhibit the desired support to the person lying thereon should conventional support systems be utilized for supporting the backrest at its lowered position.

Applicant's above-referenced U.S. patent application Ser. No. 07/496,520 discloses a chaise lounge that overcomes the above-described problems. In particular, a described embodiment utilizes a pair of lock struts and a separate pair of return struts, each pivotally interconnected between the lounge's base and canopy frames.

SUMMARY OF THE INVENTION

An object to this invention is to provide an adjustable chaise lounge of the general type disclosed in my copending U.S. patent application Ser. No. 07/496,520, but that combines the lock and return functions into a single strut. The combined lock and return strut is particularly adapted for use with a lounge having a canopy composed of structural frame members, such as steel or aluminum structural tubing.

The chaise lounge of this invention comprises a stationary base frame having laterally spaced and vertically disposed sides and a horizontally disposed top adapted to retain a seating cushion thereon. A normally upright canopy frame is composed of metallic structural frame members and comprises laterally spaced and vertically disposed sides, a top, and a normally upright back, all secured together to form a hood or cowl. The canopy frame is pivoted on the base frame to permit the canopy frame to be moved through an infinite number of positions between a normal upright position and a lowered position, placing the back of the canopy frame in at least general horizontal alignment with the top of the base frame. At least one combined lock and return strut is pivotally interconnected between the canopy frame and the base frame to releasably lock the canopy frame in a selected position, between its upright and fully lowered positions, and to automatically return the canopy to its upright position in response to operator-controlled release of the locking function.

A combined lock and return strut can be pivotally interconnected between each side of the structural canopy frame and the base frame or a single strut can be interconnected therebetween. The singe strut is preferably positioned intermediate lateral sides of the lounge.

BRIEF DESCRIPTION OF THE DRAWINGS

Other objects and advantages of this invention will become apparent from the following description and accompanying drawings wherein.

DESCRIPTION OF THE PREFERRED EMBODIMENTS

GENERAL DESCRIPTION

Figure 1:
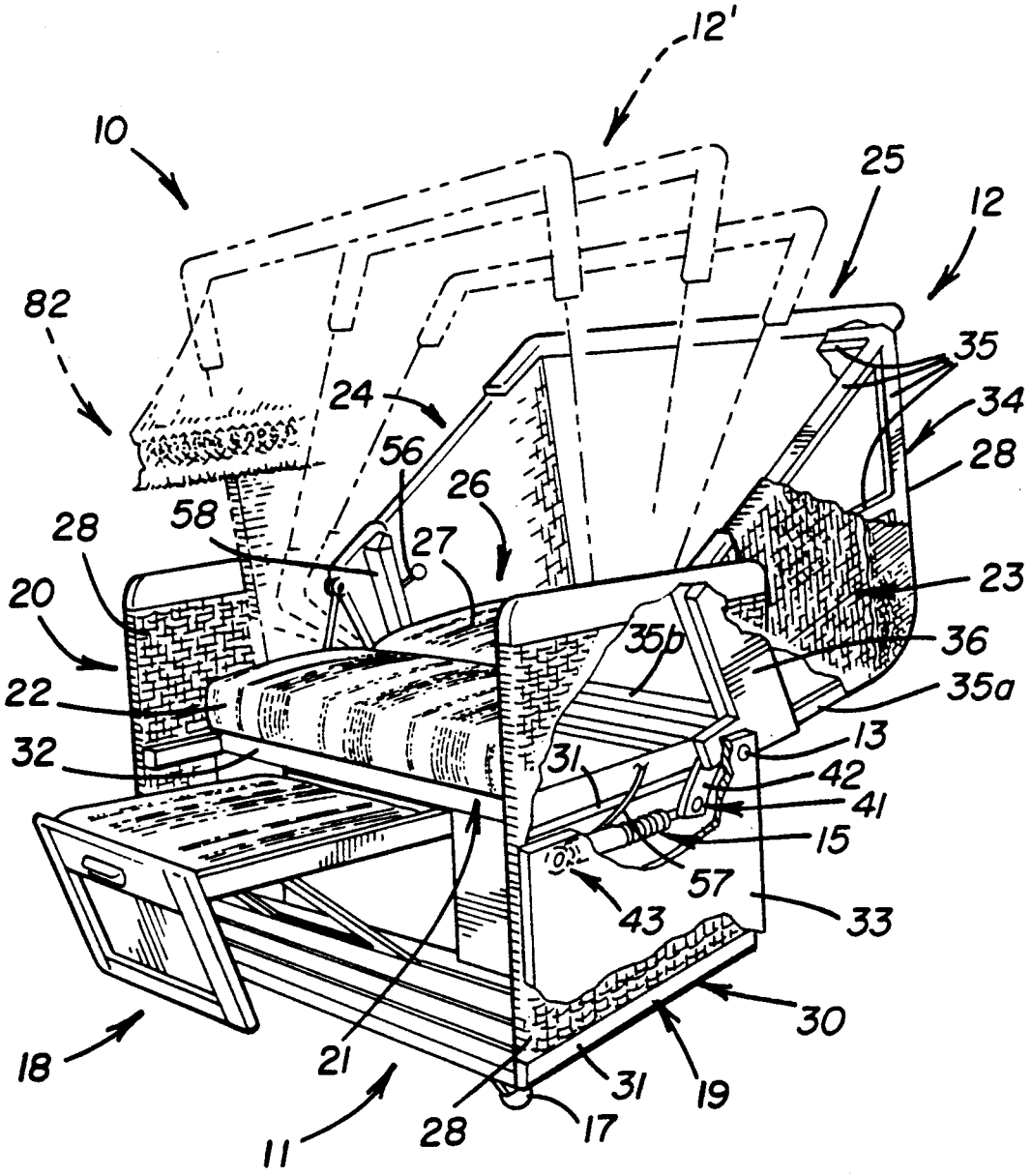
FIG. 1 is a partially sectioned frontal perspective view of a chaise lounge embodying this invention with a canopy thereof shown in its fully lowered position and further showing various raised positions of the canopy in phantom lines.

Referring to FIG. 1, a chaise lounge 10 comprises a base 11 having a canopy 12 pivotally mounted rearwardly thereon by laterally spaced and aligned pivot pins 13 (one shown). The canopy is adapted to be selectively pivoted, under controlled pushing by the user, from its normal upright position forming a seating arrangement to its illustrated full line lowered position forming a bed-like or "sunning" arrangement. As described more fully hereinafter, a hand-controlled cable system 14 (FIG. 4) is adapted to control the locking and release of a pair of laterally spaced combined lock and return means, shown in the form of struts 15 pivotally interconnected between base 11 and canopy 12. The struts provide the dual function of selectively locking the canopy in any one of an infinite number of positions between its normal upright and lowered positions and to return the canopy to its upright position automatically in response to release of the struts locking function by manipulation of cable system 14.

In addition, the struts will function to cushion movement of the canopy when it is moved from its upright position towards a lowered position. Each corner of base 11 can be mounted on a standard caster 17 to facilitate movement of the lounge into various orientations for sun bathing, viewing or other recreational pursuits. A standard collapsible and storable leg and foot rest 18 can be suitably mounted on the frontal side of base 11 for convenience of the user.

Base 11 comprises laterally spaced and vertically disposed opposite side panels 19 and 20 and a horizontally disposed top or seat panel 21, adapted to retain a seating cushion 22 thereon. The canopy comprises laterally spaced and vertically disposed sides 23 and 24, a top 25 and a normally upright back 26, adapted to have a back cushion 27 mounted thereon. Thus, when canopy 12 is moved to its fully lowered position illustrated in FIG. 1, back 26 of the canopy and top 21 of the base, as well as cushions 22 and 27, are placed in at least general horizontal alignment, relative to each other, to form the bed-like or "sunning" arrangement for the user.

The sides, top and back of the canopy are preferably covered with a woven, flexible material 28 to provide air ventilation through the canopy for convenience of the user. The woven material, underlying back cushion 27, is suspended from a frame of the canopy to provide the canopy with a high degree of structural integrity and the desired amount of flexibility. The frame of canopy is preferably constructed from wood or structural plastic, steel or aluminum tubing, as described more fully hereinafter.

DETAILED DESCRIPTION

Referring to FIG. 1, the components and constructions on opposite side of lounge 10 are substantial mirror images of each other. Base 11 may comprise a base frame 30 composed of a plurality of wooden frame members 31 suitably secured together to form a box-like rigid construction as more fully described in my co-pending U.S. patent application Ser. No. 07/496,520. Steel plates 33 are suitably secured on opposite sides of the base frame to increase the structural integrity thereof and to pivotally mount the canopy and the head ends of struts 15 thereon, as described below.

Canopy 12 comprises a canopy frame 34, formed by a plurality of structural wood, plastic, steel or aluminum members or tubings that form a very rigid skeleton frame for contiguous sides 23 and 24, top 25 and back 26 of the canopy (FIG. 1). For example, members 35 may each comprise a one-inch diameter steel tubing having a tensile strength in the approximate range of from 48,000 to 60,000 lb/in$^2$ (ANSI B36.1, ASTM A53) or comparable strength aluminum or aluminum alloy tubing. The tubing may have a cylindrical, rectangular, oval or other appropriate cross-section and wall thickness.

A steel plate 36 is welded or otherwise suitably secured to the lower end of each side of canopy frame 34 to provide structural reinforcement thereat and to pivot the lower end of each side of the canopy frame on a respective steel plate 33 of the base frame, by pin 13. As suggested above, canopy frame 34, as well as the sides and back panels of base frame 30, are preferably covered with woven material 28. The porous material provides sun and wind protection for the user, sufficient ambient air ventilation within the canopy for comfort purposes, and a structurally sound suspension system for the backrest of the canopy.

As described in my co-pending U.S. patent application Ser. No. 496,520, material 28 is suspended on the frame of the canopy to provide a hammock-like suspension for the torso of the user when the canopy is in its fully lowered or down position (FIG. 1). The material may be formed as a standard basket weave composed of rattan, vinyl or the like. Alternatively, certain lounge embodiments may find it advantageous to utilize a strong canvas or nylon mesh material for this purpose. A porous liner may be secured within the canopy, if so desired.

Laterally spaced and horizontally aligned pivot pins 13 (one shown in FIG. 1) pivotally mount rearward and lower ends of the sides of canopy frame 34 on the rearward and upper ends of the sides of base frame 30, at steel plates 33. Thus, the canopy frame is permitted to move through an infinite number of positions between its normal upright position, forming a seating arrangement, and its lowered position, placing the back of the canopy frame at least approximately horizontally and in at least general alignment with the top of base frame 30 (FIG. 1).

Each strut 15 is pivotally interconnected between a lower, rearward end of each side of canopy frame 34 and a respective side of base frame 30. In particular, the rod end of each strut 15, biased towards its extended position by a spring 40 (FIG. 3), is pivotally connected by a standard ball and socket connection (or pin) 41 on a lower extension 42 of plate 36 (or tubing 35*a* of members 35 that compose skeletal canopy frame 34). As shown in FIG. 1, the juncture at each side and back of the canopy frame comprises tubing 36*a* secured to plate 36. Extension 42 is positioned vertically below pivot pin 13 and the canopy frame. The head end and housing of each strut 15 is pivotally connected by a ball and socket connection (or pin) 43 on the inner side and forwardly on the upper end of a respective steel plate 33.

Figure 2:
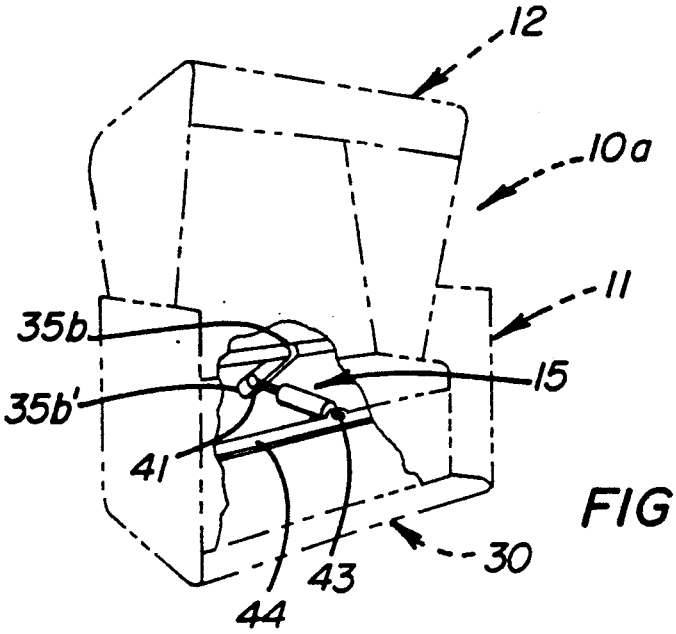
FIG. 2 schematically illustrates a modified lounge.

FIG. 2 schematically illustrates a modified lounge 10*a* in phantom lines with the modifications being shown in solid lines. In particular, a single strut 15 is pivotally interconnected between the frames of base 11 and canopy 12 in lieu of two struts 15 (FIG. 1). A steel or aluminum structural member or tubing 44 of the type described above is suitably secured between the opposite sides of base frame 30 and a crank 35*b*′ is secured on a structural cross-member or tubing 35*b* of tubings 35 (FIGS. 1 and 2). Tubing 35*b* is welded or otherwise suitably secured between outer pair of tubings 35*a*, forming part of the sides of skeletal canopy frame 34. Strut 15 is pivotally interconnected between crank 35*b*′ and member 44 at pivot connections 41 and 43, respectively, whereby extension of the strut by spring 40 will pivot the canopy to its normal upright position (FIG. 2). The strut is preferably positioned intermediate the opposite sides of the lounge. The remaining constructions and arrangements of the lounge are the same as described above.

Figure 4:
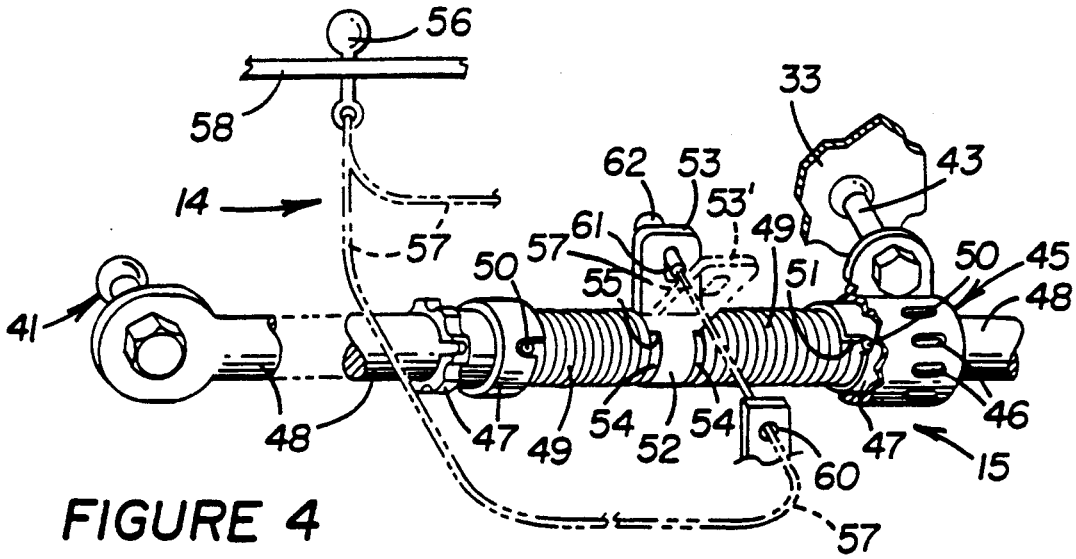
FIG. 4 schematically illustrates the combined lock and return strut and its mechanical attachment to an operator-controlled cable system with the housing of the strut being sectioned and parts removed for explanation purposes.
Figure 3:
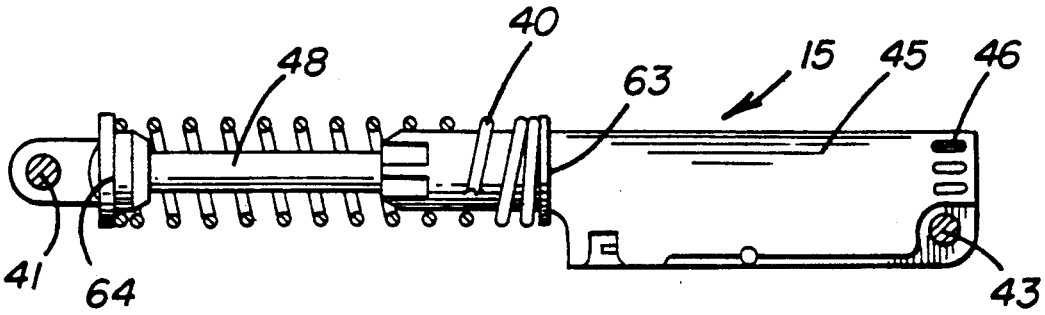
FIG. 3 illustrates a combined lock and return strut employed in the lounge.

FIG. 3 shows strut 15 in its assembled condition, whereas the strut is sectioned and spring 40 is removed in FIG. 4 for clarification and explanation purposes. Each strut comprises a tubular housing 45 suitably swaged circumferentially at 46 onto a pair of identical and longitudinally spaced collars or bushings 47 (FIG. 4). A rod 48 is reciprocally mounted in the bushings and the housing and has a pair of torsion coil springs 49 mounted thereon. One end of the rod is pivotally mounted on canopy frame 34 at pivot connection 41 whereas the opposite end of the rod freely reciprocates in housing 45. A distal end 50 of each spring is captured within a slot 51, defined on an inner end of a respective bushing 47. A centrally disposed collar 52 is rotatably mounted on rod 48 and has an actuation lever 53 extending radially outwardly therefrom.

A proximal end 54 of each spring is captured within a slot 55 defined in collar 52. Thus, rotation of lever 53 to its phantom-line or release position 53' and against the helix directions of the coil springs will expand their mean diameters to release torsional friction on the rod to permit it to reciprocate therein. When lever 53 is in its normal full line "locked" position, the coils of the springs will contract automatically to provide lock means frictionally gripping rod 48 to thus hold and lock the rod and canopy 12 in a selected position.

Referring to FIGS. 1 and 4, cable system 14 comprises a schematically illustrated operator-controlled reciprocal handle (or slide button) 56, adapted to selectively and simultaneously reciprocate a pair of flexible cables 57 to release the frictional gripping forces imposed on rods 48 by springs 49 of struts 15. Handle 56 is suitably mounted on a plate 58, secured on an inner side of sidewall 24 (or 23) within canopy 12, as schematically shown in FIG. 2. The standard cables are suitably guided by brackets (not shown) secured on base frame 30 and canopy frame 34 to ensure that a pulling of the cables will function to simultaneously unlock struts 15.

Referring to FIG. 4, a distal end of each cable 57 extends through a slot formed through a bracket 60 secured on housing 45 and further extends through a slot 61 formed in lever 53 and is anchored thereon. Thus, pulling of cable 57 will engage an enlarged terminal end 62 of the cable behind the lever to pivot the lever for release of the strut. In particular, when the lever is rotated by the cable to its phantom-line position 53', it will rotate collar 52 generally clockwise in FIG. 4 to release the gripping force of spring 49 on rod 48.

Housing 45, pivotally mounted on plate 33 by pin or ball and socket connection 45, will pivot on the connection to compensate for relocation of the canopy to its selected position. Further detailed description of strut 15 and its attendant actuating mechanisms can be found in U.S. Pat. No. 3,874,480. These types of struts can be purchased from P.L. Porter Company of Woodland Hills, California under its Model No. MM65-1016 for a "Single Linear Locking Device with Remote Control" (Mechlok or DOUBLE-LOK).

As stated above, strut 15 functions to automatically return canopy 12 to its upright position from a lowered position, in response to release of handle 56 of cable system 14. Suitably calibrated compression coil spring 40 is mounted between a first washer 63 secured on housing 45 and a second washer 64 secured on a distal end of rod 48 (FIG. 4). Thus, the spring will compress to provide a cushioning function when the canopy is pushed by the user to a lowered position and will expand to automatically return the canopy to its upright position when handle 56 is manipulated to release lock springs 49 from rod 48 (FIG. 4).

I claim:

1. A chaise lounge usable for sun bathing and the like comprising a base frame having laterally spaced and vertically disposed sides and a horizontally disposed top adapted to retain a seating cushion thereon, a normally upright canopy frame having laterally spaced and vertically disposed sides, a top and a normally upright back all secured together to form a hood open on its frontal side thereof, pivot means for pivotally mounting a lower end of each side of said canopy frame on said base frame for permitting said canopy frame to be moved through an infinite number of positions between a normal upright position to form a seating arrangement and a fully lowered position placing the back of said canopy frame in at least general horizontal alignment with the top of said base frame to form a bed, and combined lock and return means pivotally interconnected between said canopy frame and said base frame for selectively and releasably holding and locking said canopy frame in a selected lowered position between its upright and fully lowered positions and for automatically returning said canopy from its selected position to its upright position in response to releasing said locking of said canopy frame.

2. The sheltering lounge chair of claim 1 wherein a said combined lock and return means is pivotally interconnected adjacent to each side of said canopy frame and said base frame.

3. The sheltering lounge chair of claim 2 wherein a single said combined lock and return means is pivotally interconnected intermediate the sides of said base and canopy frames.

4. The sheltering lounge chair of claim 1 or 2 wherein said combined lock and return means includes means for cushioning movement of said canopy frame when it is moved from its upright position towards its fully lowered position and for automatically moving said canopy frame from its selected position to its upright position in response to releasing said locking of said canopy frame.

5. The sheltering lounge chair of claim 1 or 2 further comprising operator-control means mounted within said canopy frame for ready access to a person therein for selectively releasing said lock and return means.

6. The sheltering lounge chair of claim 2 wherein said canopy frame comprises a plurality metallic tubings secured together to form a skeletal construction.

7. The sheltering lounge chair of claim 6 wherein said tubings each constitute steel, aluminum or an aluminum alloy.

8. The sheltering lounge chair of claim 6 wherein the sides, top and back of said canopy frame are each formed from said tubing and are each covered with a material exhibiting a porous basket weave.

9. The sheltering lounge chair of claim 8 wherein each said lock and return means comprises a housing pivotally mounted forwardly on a respective side of said base frame and a rod reciprocally mounted in said housing and having a distal end thereof pivotally connected to a respective side of said canopy frame.

10. The sheltering lounge chair of claim 9 wherein the juncture at each side and the back of said canopy frame comprises one of said tubings that forms an extension positioned vertically below said pivot means and said canopy frame and wherein the distal end of said rod is pivotally connected to said extension.

11. The sheltering lounge chair of claim 9 wherein said lock and return means comprises locking means engageable with said rod for selectively holding said rod in a selected position within said housing to control the selected position of said canopy frame on said base frame and compression spring means mounted between said housing and said rod for cushioning movement of said canopy frame from its upright position towards its fully lowered position and for automatically returning said canopy frame from its selected lowered position to its upright position in response to releasing of said locking means.

12. The sheltering lounge chair of claim 11 further comprising operator-control means, including an operator-control mounted on said canopy frame, for selectively actuating and releasing said locking means to enable repositioning said rod relative to said housing.

13. The sheltering lounge chair of claim 12 wherein said locking means includes torsion spring means mounted on said rod and in said housing for normally applying torsional friction and a gripping force to said rod to hold it in a selected reciprocal position relative to said housing and for releasing said gripping force when said torsion spring means is expanded circumferentially in response to selective manipulation of said operator-control.

14. The sheltering lounge chair of claim 13 wherein said operator-control is reciprocally mounted interiorly on said canopy frame and wherein said operator-control means further comprises flexible actuating cable means for selectively actuating said locking means to release the gripping force on said torsion spring means in response to selective reciprocation of said operator-control.

* * * * *